US005837954A

United States Patent [19]

Asakawa et al.

[11] Patent Number: 5,837,954

[45] Date of Patent: Nov. 17, 1998

[54] CIRCUIT BREAKER

[75] Inventors: Koji Asakawa; Naoshi Uchida; Kyoji Hama, all of Kawasaki, Japan

[73] Assignee: Fuji Electric Co., Ltd., Kanagawa, Japan

[21] Appl. No.: 688,982

[22] Filed: Jul. 31, 1996

[30] Foreign Application Priority Data

Aug. 3, 1995 [JP] Japan ..... 7-218150

[51] Int. Cl.[6] ..... H01H 33/20

[52] U.S. Cl. ..... 218/40; 335/201

[58] Field of Search ..... 218/15–22, 29, 218/30, 32–34, 36–40, 46, 76, 103, 146–151; 335/2, 6, 8, 16, 147, 170, 174, 200–203

[56] References Cited

U.S. PATENT DOCUMENTS

| | | | |
|---|---|---|---|
| 4,451,718 | 5/1984 | Yamagata et al. | 200/147 R |
| 4,511,774 | 4/1985 | Forsell | 200/147 R |
| 4,642,428 | 2/1987 | Yoshiyasu et al. | 200/144 R |
| 4,689,588 | 8/1987 | Murata et al. | 335/201 |
| 4,743,720 | 5/1988 | Takeuchi et al. | 200/147 R |
| 5,185,590 | 2/1993 | DiVincenzo | 335/201 |

FOREIGN PATENT DOCUMENTS

| | | | |
|---|---|---|---|
| 96548/1980 | 12/1953 | Japan . | |
| 1-151116 | 6/1989 | Japan | H01H 9/44 |

*Primary Examiner*—Michael A. Friedhofer
*Attorney, Agent, or Firm*—Pearne, Gordon, McCoy & Granger LLP

[57] ABSTRACT

A bent roundabout current path (8*d*) rising in the shape of an inverted U is formed between a horn portion (8*a*) and the end portion of a fixed contact (1) where an arcing horn (8) is joined to the fixed contact (1). An arc (12) is subjected to the electromagnetic force directed to an arc-extinguishing chamber side from the magnetic field H of an current I flowing through the arc-(12)-side conductor portion of the roundabout current path (8*d*). Therefore, the moving-contact-(4)-side foot of the arc (12) is retained in the leading end portion of the moving contact (4) and not returned to the movable contact (3) side.

20 Claims, 10 Drawing Sheets

CIRCUIT BREAKER

BACKGROUND OF THE INVENTION

The present invention relates to a circuit breaker such as a molded-case circuit-breaker, an earth leakage breaker or the like and more particularly to improvement in an arcing horn.

An arcing horn (arcing runner) in a circuit breaker functions as what promotes the extinction of an arc by causing the foot of the arc produced between contacts at the time of current cut-off to transfer to an arc-extinguishing chamber side. FIG. 17 is a vertical sectional view showing an example of a conventional circuit breaker having an arcing horn of the sort mentioned above. The circuit breaker illustrated in FIG. 17 is held "on" and the current flows from a fixed contact 1 toward a load-side terminal plate 7 via a moving contact 4 having a movable contact 3 in contact with a stationary contact 2, a lead wire 5, and the trip coil 6*a* of an overcurrent trip device 6. The fixed contact 1 is in the form of a flat-plate conductor having not only a power-supply-side terminal portion la integrally formed at its one end but also the stationary contact 2 fitted to the other end. Moreover, the fixed contact 1 is provided with an arcing horn 8 having a horn portion 8*a* obliquely projecting upward from the stationary contact (2) side toward the terminal portion (1*a*) side.

When the energizing current is brought to the overcurrent state in this case, the armature 6*b* of the overcurrent trip device 6 is so attracted as to make a trip mechanism 9 unlock a switching mechanism 10. The moving contact 4 is driven up to a contact parting position as shown by a chain line because of the energy stored in a switching spring 11, so that the current is cut off. At the time of the current cut-off, an arc is produced between the contacts 2, 3 and drawn into the arc-extinguishing grids 13 of an arc-extinguishing chamber 12 before being extinguished because of the synergistic effect of extension, division and cooling. Then the arcing horn 8 functions as what moves the stationary-contact-(2)-side foot of the arc 12 toward the horn portion 8*a* and leads the arc 12 to the inner part of each arc-extinguishing grid 13.

In the case of the fixed contact 1 of FIG. 17, however, the electromagnetic force F generated in the arc 12 due to the magnetic field H of the current I flowing therethrough impedes the arc-extinguishing action because it operates in a direction opposite to the direction in which the arc 12 is elongated. Consequently, another known circuit breaker is arranged so that, as shown in FIG. 18, by folding back the end portion of a fixed contact 1 in the shape of U, a stationary contact 2 is fitted onto the end portion thus folded back. As the direction of a current I is reversed in the end portion thus folded back, the electromagnetic force F due to the magnetic field H of the current I is directed in the same direction in which an arc 12 is made to elongate and the foot of the arc 12 is quickly moved to an arcing horn 8.

In the case of the fixed contact 1 of FIG. 18 with the end portion folded back, the fitting position of the stationary contact 2 becomes higher and the distance between the stationary contact 2 and the moving contact 4 in the contact parting state, that is, a contact parting distance tends to decrease to that extent; therefore, the height of the circuit breaker will have to be increased to secure the contact parting distance if the intended breaking performance is not obtainable from the decreased distance therebetween. In other words, the circuit breaker becomes large in size proportionally. Consequently, there has been developed a circuit breaker so designed as to have the current reversed without folding back the end portion of such a fixed contact in order to improve the aforementioned situation (Japanese Utility Model Laid-Open No. 96548/1980).

FIG. 19 is a plan view of the fixed contact 1 of a circuit breaker of the sort stated above and FIG. 20 a side view of one portion in cross section taken on line XX—XX of FIG. 19. As shown in FIG. 19, a U-shaped slit 15 is bored in the right-end portion of the fixed contact 1 in the form of a flat-plate conductor with a power-supply-side terminal portion 1*a* in the left-end portion of FIG. 19. There are formed outside current paths 1*b* and an inside current path 1*c*, the former resulting from branching off left and right from the terminal portion la via the U-shaped slit 15, the latter resulting from the convergence of both the leading ends of the former and from turning back the combined path toward the terminal portion 1*a*. A stationary contact 2 is fitted to the tip end of the inside current path 1*c*. Thereby the current made to flow in from the terminal portion la branches off into the outside current paths 1*b* and as the tip ends of the outside current paths converge, flows through the inside current path 1*c* toward the stationary contact 2. In consequence, the arc 12 generated at the time of current cut-off is subjected to the leftward electromagnetic force F as shown in FIG. 20 because of the magnetic field H of the current flowing through the inside current path 1*c*.

FIGS. 21 and 22 illustrate a device which is the subject of commonly owned and co-pending U.S. patent application Ser. No. 08/668,438.

FIG. 21 is a plan view of a state in which a U-shaped arcing horn 8 extending along the outside current paths 1*b* is fitted onto the surface of the fixed contact 1 of FIG. 19; and FIG. 22 a side view thereof. The arcing horn 8 is formed into a U-shape with its arm portions 8*b*, the distance therebetween being the same as the distance between the outside current paths 1*b*, and the horn portion 8*a* thereof which is obliquely raised by bending. Columnar projections protruded out from the fixed contact (1) side are caulked into fitting holes at the tip ends of the arm portions 8*b* of the arcing horn 8. The arcing horn 8 is thus secured to the fixed contact 1. On receiving the electromagnetic force F, the foot of the arc 12 is caused to move to the horn portion 8*a* of the arcing horn 8. However, the arc 12 is still subjected to the electromagnetic force F due to the magnetic field H of the current I flowing through the arm portion 8*b* even after it transfers onto the arcing horn 8.

In the aforesaid circuit breaker, the arc-extinguishing operation has heretofore been performed by making the electromagnetic force of the current flowing through the fixed contact 1 act on an arc and simultaneously drawing the arc transferred to the arcing horn into the arc-extinguishing grids. Since the elongation of the arc on the movable contact side is insufficient in that case, the arc is caused to stay at the movable contact when a large current is cut off and its consumption is increased. The problem is that limitations may be imposed on breaking performance.

SUMMARY OF THE INVENTION

It is therefore an object of the present invention to provide an arrangement in which an arc is made sufficiently extensible even on a movable contact side by strengthening the action of electromagnetic force for driving the arc toward an arc-extinguishing chamber.

In order to solve the foregoing problems, a circuit breaker according to the present invention has a fixed contact in the form of a flat-plate conductor with a terminal portion formed at its one end and a stationary contact fitted to the other end, an arcing horn having a horn portion obliquely projecting upward from the stationary contact side toward the terminal portion being provided for the fixed contact, wherein the arcing horn is formed into a U-shape having the horn portion extended in the width direction of the fixed contact and a bilateral pair of arm portions each linked with both ends of the horn portion; a bent roundabout current path rising in the shape of an inverted U is formed between the leading end portions of the arm portions and the horn portion; and the arcing horn is coupled onto the surface of the fixed contact in the leading end portions of its arm portions in such a manner that the roundabout current path is situated opposite to the terminal portion of the fixed contact with respect to the moving path of the movable contact of a moving contact detached from the fixed contact.

With this arrangement, the direction of the current flowing through the conductor on the arc side of the inverted-U-shaped roundabout current path becomes opposite to the arc when the foot of the arc moves to the arcing horn, and thus the arc is subjected to electromagnetic force in the direction in which the arc is elongated. Since the electromagnetic force acts on a portion ranging from the foot of the fixed-contact-side arc up to that of the movingcontact-side arc, the foot of the arc even on the moving contact side is maintained in the leading end portion of the moving contact, whereby arc loss due to its retention at the movable contact is reduced.

When the current is inverted in the aforesaid circuit breaker in a case where the end portion of the fixed contact is not folded back, the outside current paths resulting from branching off left and right from the terminal portion and the inside current path resulting from the convergence of the leading ends of the outside current paths and from turning back the combined path toward the terminal portion are formed in the end portion of the side where the stationary contact of the fixed contact is installed via a U-shaped slit. Further, the stationary contact is fitted to the tip end of the inside current path and the arm portions of the arcing horn are coupled to the leading end portions of the respective outside current paths.

In the aforesaid circuit breaker, further, by consecutively bending the roundabout current path twice, the electrical resistance of the current paths formed with the arcing horn is made increasable and an increase in the value of breaking current is made suppressible. In this case, it may be more effective to use high resistance materials such as nickel, chrome alloy and the like for such an arcing horn.

In the aforesaid circuit breaker, further, electromagnetic repulsion force can be made to act on the moving contact from the roundabout current path in the separating direction of the moving contact by setting the upper-end bent portion of the roundabout current path lower than the conductor portion of the detached moving contact and simultaneously providing a portion parallel to the conductor portion for the upper-end bent portion.

In the aforesaid circuit breaker, further, fitting the roundabout current path with a resin-molded insulating cover prevents the portion thus covered therewith from being damaged by an arc. In this case, an arc-extinguishing-grid support may be formed as an integral part of the insulating cover.

DETAILED DESCRIPTION OF THE PREFERRED EMBODIMENTS

Figure 1:
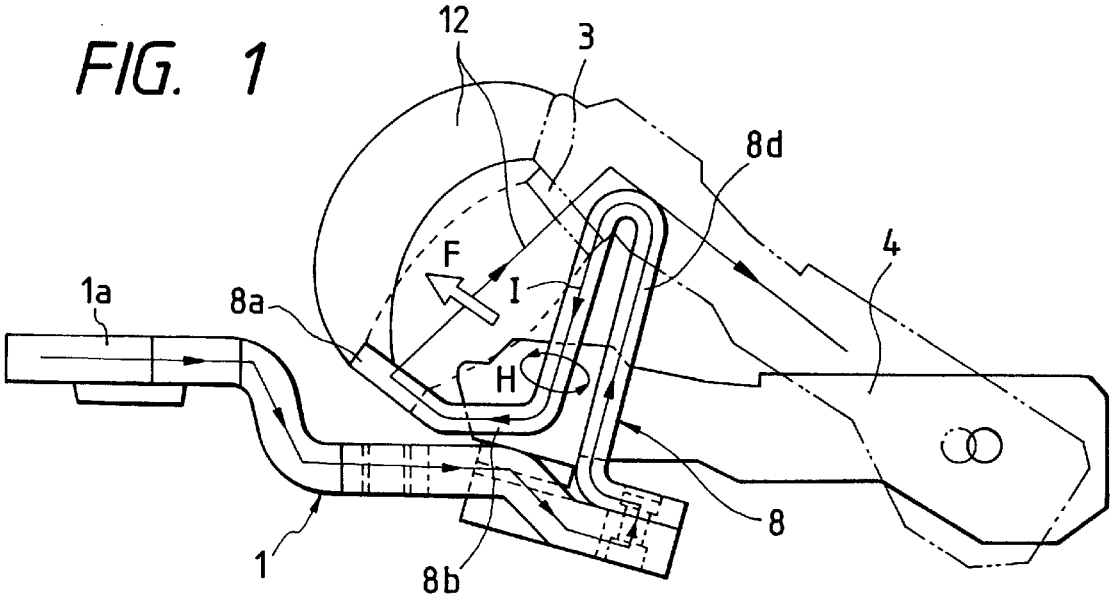
FIG. 1 is a side view of a contact portion in Embodiment 1 of the present invention.

Referring to FIGS. 1 through 16 inclusive, there will subsequently be given a description of embodiments of the present invention, wherein like reference characters designate like or corresponding parts of the above-described conventional circuit breakers.

Embodiment 1

Figure 2:
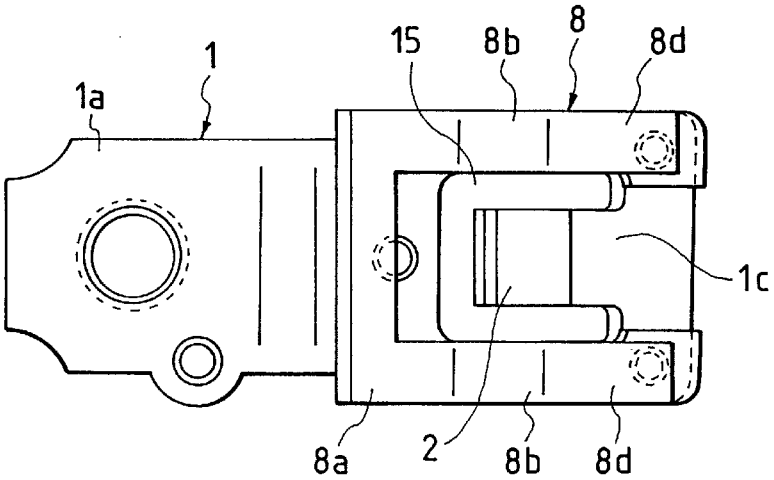
FIG. 2 is a plan view of a fixed contact of FIG. 1.
Figure 3:
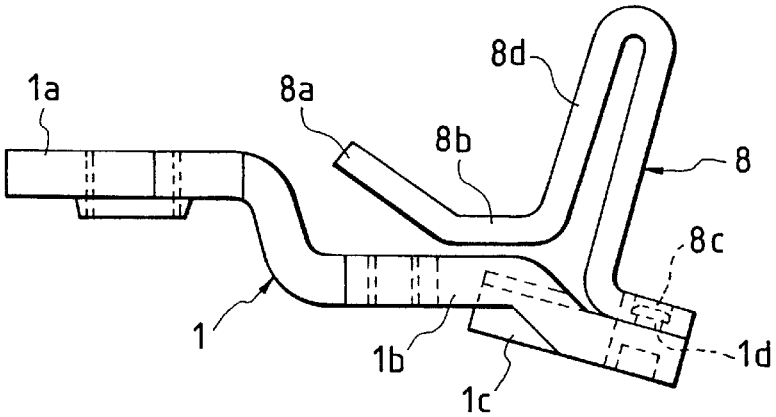
FIG. 3 is a side view of the fixed contact of FIG. 2.

FIGS. 1–3 show an embodiment of the present invention: FIG. 1 is a side view of a contact portion; FIG. 2 a plan view of a fixed contact 1 in FIG. 1; and FIG. 3 a side view of the fixed contact 1. The fixed contact 1 in the form of a flat-plate conductor is provided with a terminal portion 1*a* for the power supply side, which is located in the left-hand end portion of FIGS. 2 and 3. A U-shaped slit 15 is bored in the right-hand end portion of the fixed contact 1 so as to define a pair of outside current paths 1*b* and an inside current path 1*c*. The outside current paths 1*b* branch off left and right from the terminal portion 1*a*, and the inside current path 1*c* turns back toward the terminal portion 1*a* from a portion where both the leading ends of the outside current paths 1*b* are combined together. A stationary contact 2 is fitted to the tip end of the inside current path 1*c*. Further, a U-shaped arcing horn 8 extending along the outside current paths 1*b* is fitted onto the upper surface of the fixed contact 1.

The arcing horn 8 is formed into a U-shape with a horn portion 8*a* extending over the width direction of the fixed contact 1 and a pair of arm portions 8*b* coupled to the respective lateral ends of the horn portion 8*a*. The arcing horn 8 is bent so that the horn portion is obliquely raised. The arcing horn 8 is secured to the fixed contact 1 such that columnar projections id protruded out from the fixed contact side 1 are caulked into fitting holes 8*c* at the leading ends of the arm portions 8*b*. The width of the outside current path 1*b* is the same as the width of the arm portion 8*b*. A bent roundabout current path 8*d* rising in the shape of an inverted U is formed between the leading end portions of the left- and right-handed arm portions 8*b* and the horn portion 8*a* of the arcing horn 8. The roundabout current path 8*d* is situated opposite to the terminal portion la of the fixed contact 1 with respect to the moving path of the movable contact 3 of a moving contact 4 detached from the fixed contact 1 (see FIG. 1).

When the moving contact 4 is opened as shown by a chain line in reference to FIG. 1, an arc 12 is produced between the contacts 2, 3 and when the foot of the arc 12 moves to the horn portion 8*a* of the arcing horn 8, a current I passes through the arm portions 8*b* of the arcing horn 8 as shown therein. The magnetic field H of the current I flowing through the conductor on the arc (12) side of the roundabout current path 8*d* then causes the electromagnetic force F in the direction of an arrow to act on the arc 12 and drives the arc toward the terminal portion (1*a*) side. Therefore, the arc 12 is elongated in a curved condition as shown by a solid line and drawn into arc-extinguishing grids (not shown) for extinction. In the meantime, the arc 12 is subjected to the electromagnetic force F from the current I in the roundabout current path 8*d* entirely from the foot of the fixed contact (1) side up to that of the moving contact (4) side, and the feet of the arc 12 are each maintained at the tip ends of the horn portion 8*a* and moving contact 4.

Embodiment 2

Figure 4:
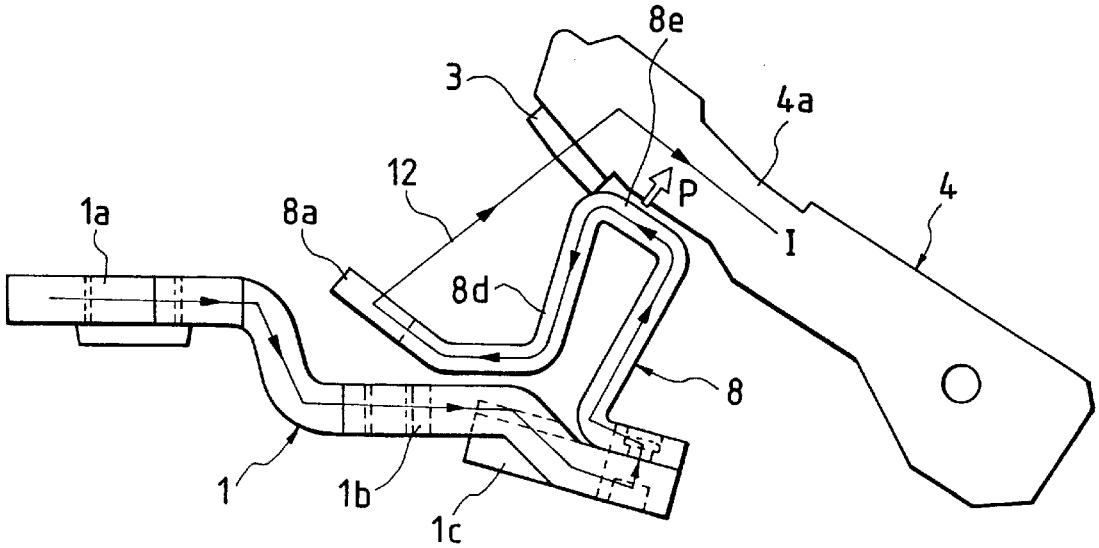
FIG. 4 is a side view of a contact portion in Embodiment 2 of the present invention.

FIG. 4 is a side view of another contact portion embodying the present invention wherein a portion 8*e* parallel to the conductor portion 4*a* of the moving contact 4 is provided in the upper bent portion of the roundabout current path 8*d*. According to this embodiment of the invention, the upper bent portion of the roundabout current path 8*d* is positioned lower than the conductor portion 4*a* of the detached moving contact 4, and the portion 8*e* parallel to the conductor portion 4*a* is provided in the upper bent portion. According to this Embodiment 2 of the invention, electromagnetic repulsion force P acts between currents I each flowing through the parallel portion 8*e* and the conductor portion 4*a* in opposite directions, whereby the breaking performance is improved because the repulsion force P suppresses the return of the moving contact 4 toward the fixed contact (1) side resulting from reaction at the time the moving contact 4 is detached.

Embodiment 3

Figure 5:
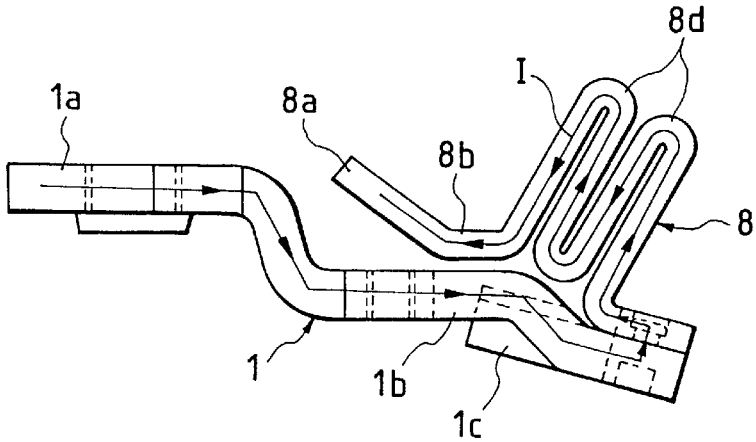
FIG. 5 is a side view of a fixed contact in Embodiment 3 of the present invention.

FIG. 5 is a side view of still another contact portion embodying the present invention wherein the roundabout current path 8*d* is consecutively bent twice. According to this embodiment of the invention, the path of the current I flowing through the arcing horn 8 becomes longer to the extent that the number of bendings is increased. Consequently, breaking performance is improved because the electrical resistance is increased to that extent with the effect of suppressing the current even when a large current is cut off. It may be more effective to use high resistance materials such as nickel, chrome alloy and the like for such an arcing horn 8.

Embodiment 4

Figure 6:
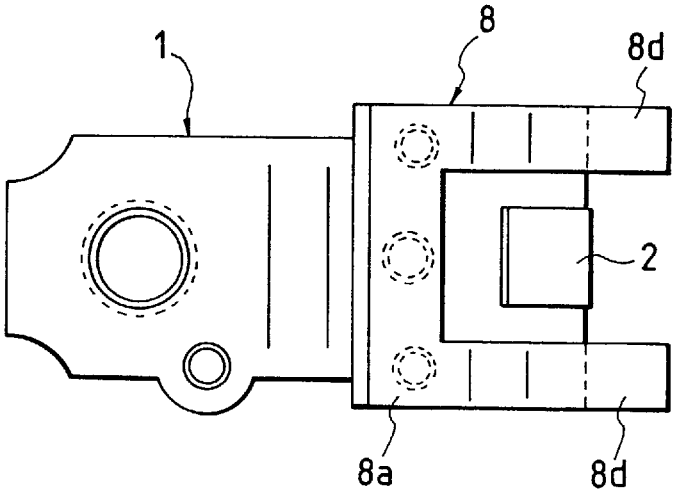
FIG. 6 is a plan view of a fixed contact in Embodiment 4 of the present invention.
Figure 7:
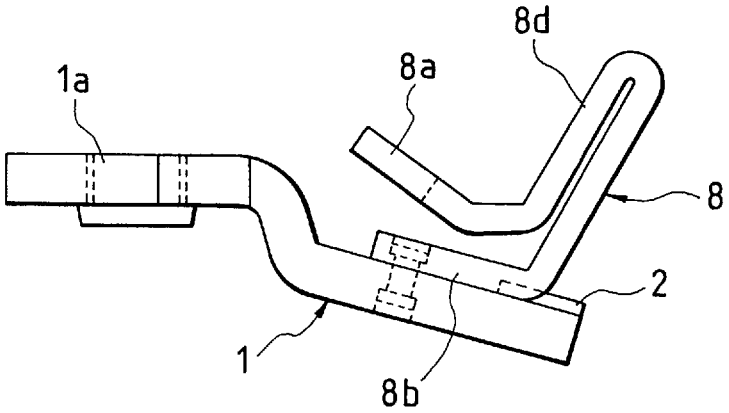
FIG. 7 is a side view of the fixed contact of FIG. 6.

FIGS. 6 and 7 illustrate another fixed contact 1 embodying the present invention wherein the terminal portion 1*a* is formed at one end of a simple flat-plate conductor and the stationary contact 2 is fitted to the other. FIGS. 6 and 7 are a plan view and a side view of such a fixed contact, respectively. The leading end portions of the arm portions 8*b* of the arcing horn 8 are directed in the same direction as that of the horn portion 8*a* thereof and coupled to the fixed contact 1. Although this fixed contact 1 is disadvantageous for the elongation of an arc as stated above, the disadvantage is reducible by providing the roundabout current path 8*d* for the arcing horn 8.

Embodiment 5

Figure 8:
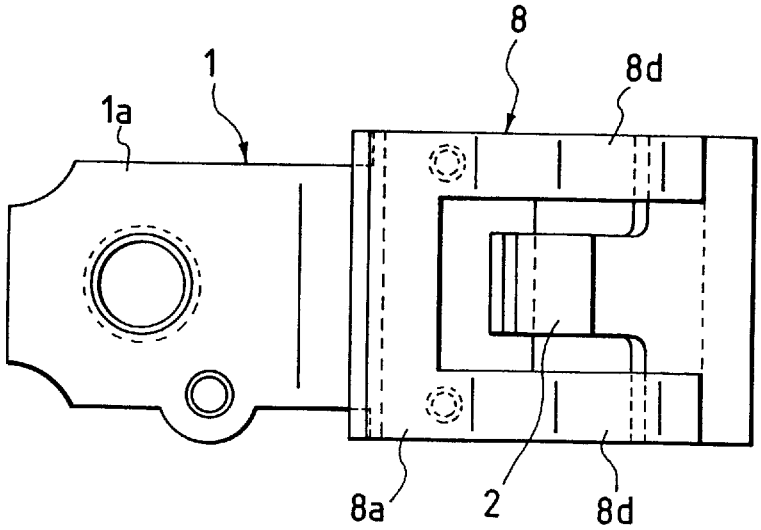
FIG. 8 is a plan view of a fixed contact in Embodiment 5 of the present invention.
Figure 9:
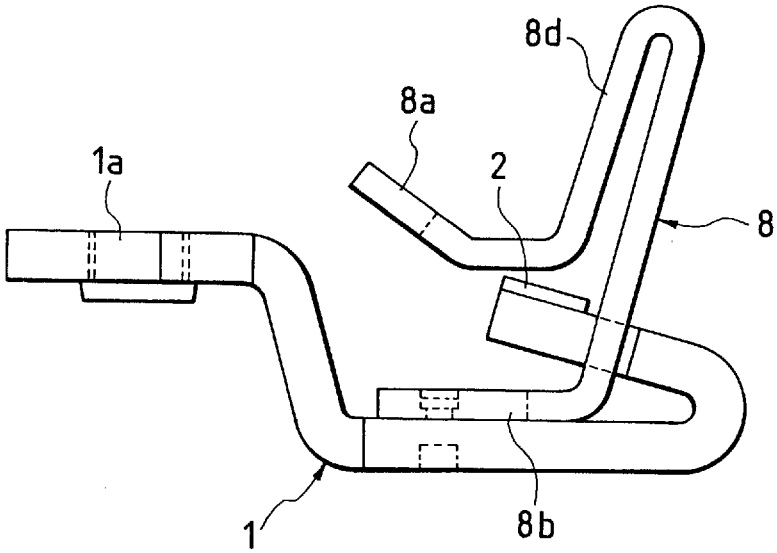
FIG. 9 is a side view of the fixed contact of FIG. 8.

FIGS. 8 and 9 illustrate still another fixed contact 1 embodying the present invention wherein one end of the flat-plate conductor is folded back into a U-shape and stationary contact 2 is fitted onto the end portion thus folded back. FIGS. 8 and 9 are a plan view and a side view of the fixed contact 1, respectively. Both lateral sides of the end portion thus folded back are removed to reduce the width of the end portion of the fixed contact 1, and the stationary contact 2 having the same width as that of the thus width-reduced end portion thereof is fitted thereto. The arcing horn 8 is coupled to a portion of the fixed contact 1 in front of the U-bent portion of the fixed contact 1 through the leading end portions of the arm portions 8*b* of the arcing horn 8 located in the same side as the horn portion 8*a* is provided.

Embodiment 6

Figure 10:
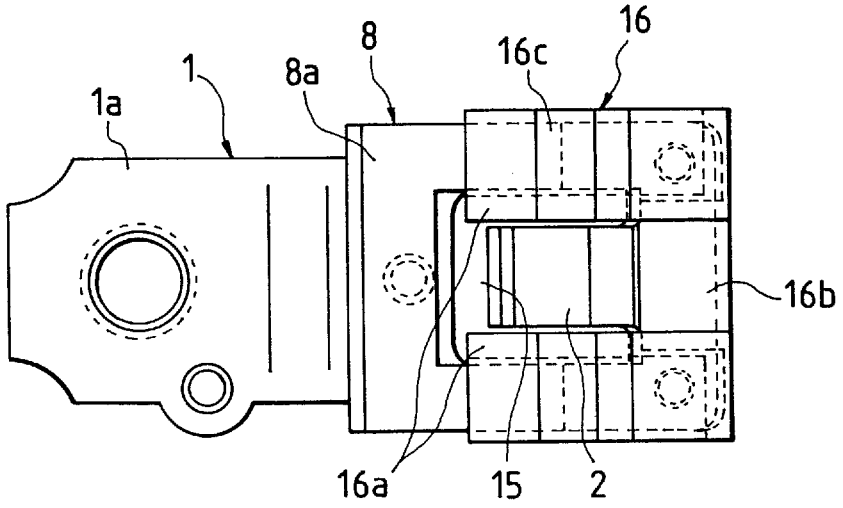
FIG. 10 is a plan view of a fixed contact in Embodiment 6 of the present invention.
Figure 11:
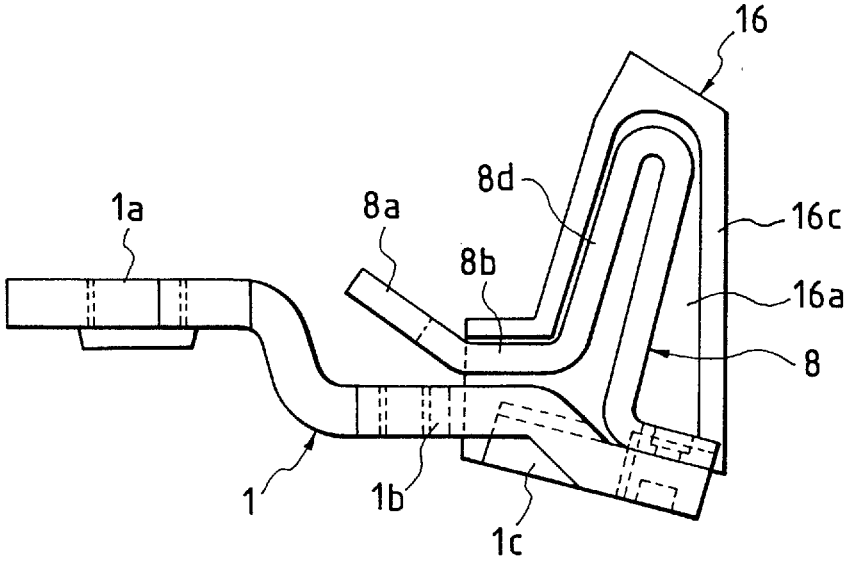
FIG. 11 is a side view of the fixed contact of FIG. 10.
Figure 12A:
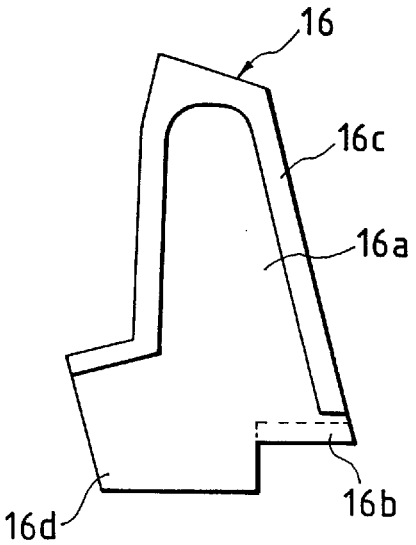
FIG. 12(A) is a side view of an insulating cover.
Figure 12B:
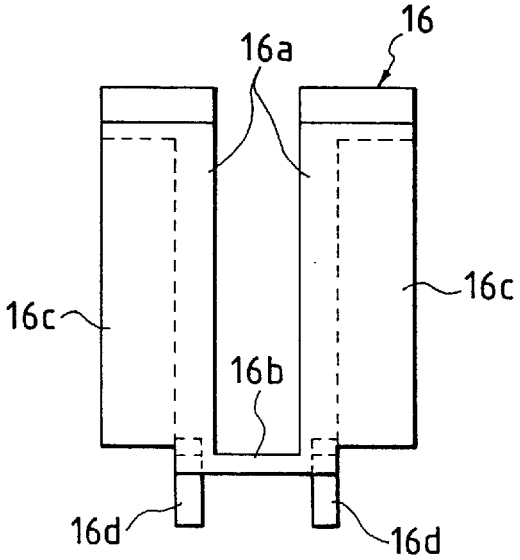
FIG. 12(B) a rear elevation thereof.

FIGS. 10–12 illustrate a further embodiment of the present invention wherein an insulating cover 16 is provided for the roundabout current path of the Embodiment 1 of the invention. FIG. 10 is a plan view of the fixed contact 1; FIG. 11 a side view thereof; FIG. 12(A) a side view of the insulating cover; and FIG. 12(B) a rear elevation thereof. The insulating cover 16 includes a lateral pair of side walls 16*a* and a flat-plate portion 16*b* coupling the side walls in the lower portion, these being integrally formed of molded resin. Inverted U-shaped flanges 16*c* are overhung on the outer faces of the left- and right-hand side walls 16*a* so that a recess for accommodating the roundabout current path 8*d* is formed. Moreover, leg portions 16*d* are projected in the lower end portions of the side walls 16*a*.

The insulating cover 16 is inserted into a space between the roundabout current paths 8*d* from above the fixed contact 1, and the leg portions 16*d* are fitted in the left-and right-hand arm portions of the U-shaped slit 15 bored in the fixed contact 1. The lower end edge faces of the flanges 16*c* abut against the upper surface of the arcing horn 8 and simultaneously the flat-plate portion 16*b* abuts against the surface of the inside current path 1*c*, whereby these parts are fitted in as shown in FIGS. 10, 11. Therefore, the arcing horn 8 with the exception of the horn portion 8*a* and the inside current path 1*c* with the exception of the stationary contact 2 are covered with the insulating cover 16 and insulated from the arc. Consequently, the roundabout current path 8*d* is set free from being exposed to the arc and thus made free from wearing, and the travel of the arc foot from the stationary contact 2 to the horn portion 8*b* is promoted. Resin, for example, melamine resin, which is likely to produce an arc-extinguishing gas (e.g., hydrogen gas) in contact with the arc which hardly produces carbon as a source of reducing insulating resistance after current cut-off is suitable for use as material of such an insulating cover 16.

Embodiment 7

Figure 13:
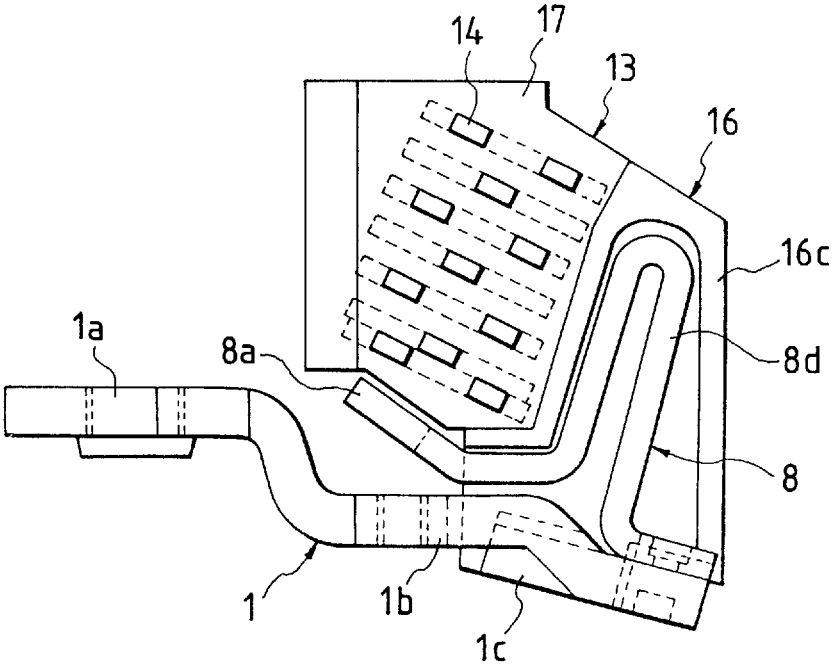
FIG. 13 is a side view of a fixed contact in Embodiment 7 of the present invention.
Figure 14A:
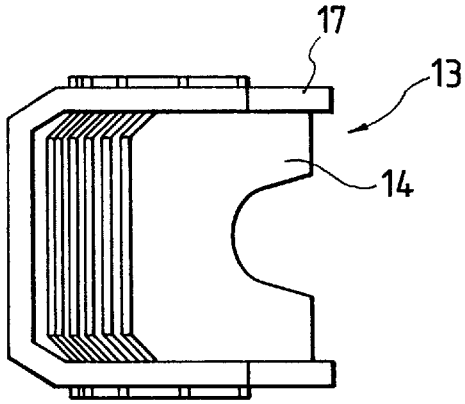
FIG. 14(A) is a plan view of an arc-extinguishing chamber.
Figure 14B:
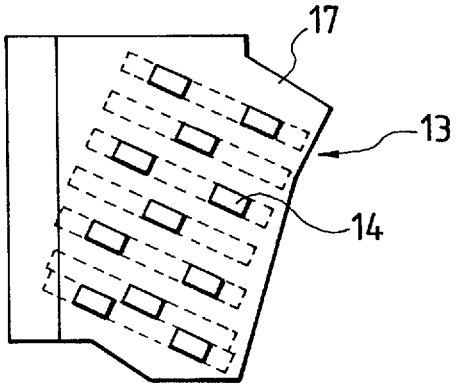
FIG. 14(B) a side view thereof.

FIGS. 13 and 14 illustrate Embodiment 7 of the present invention wherein an arc-extinguishing chamber 13 is placed on the front of the insulating cover 16 of Embodiment 6 of the invention. FIG. 13 is a side view of the fixed contact 1; FIG. 14(A) a plan view of the arc-extinguishing chamber 13 of FIG. 13; and FIG. 14(B) a side view thereof. The arc-extinguishing chamber 13 includes a U-shaped grid supporting member 17 and a multi-stage arc-extinguishing grid 14 which is fitted to the grid supporting member by caulking. The edge faces of the left- and right-hand side walls of the grid supporting member 17 are formed so as to extend along the front of the flanges 16*c* of the insulating cover 16. The grid supporting member 17 is, as shown in FIG. 13, combined with the insulating cover 16 and held down by a main cover (not shown) of the circuit breaker.

Embodiment 8

Figure 15:
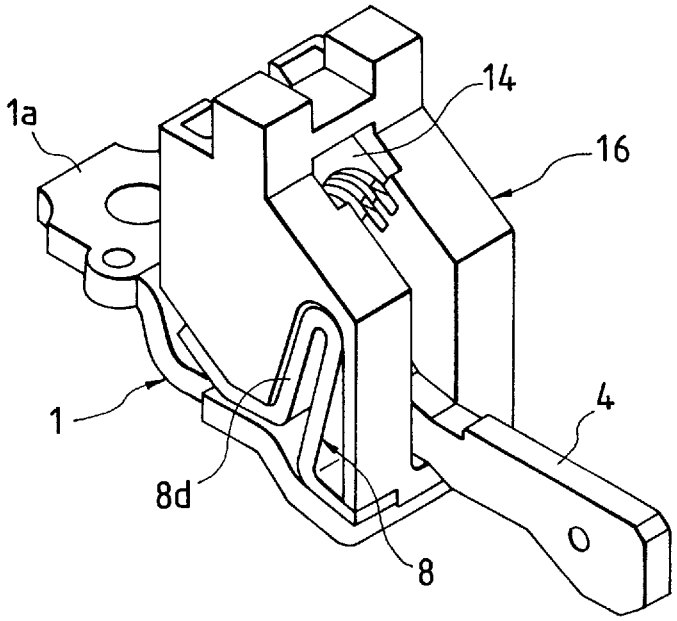
FIG. 15 is a perspective view of a contact portion in Embodiment 8 of the present invention.
Figure 16:
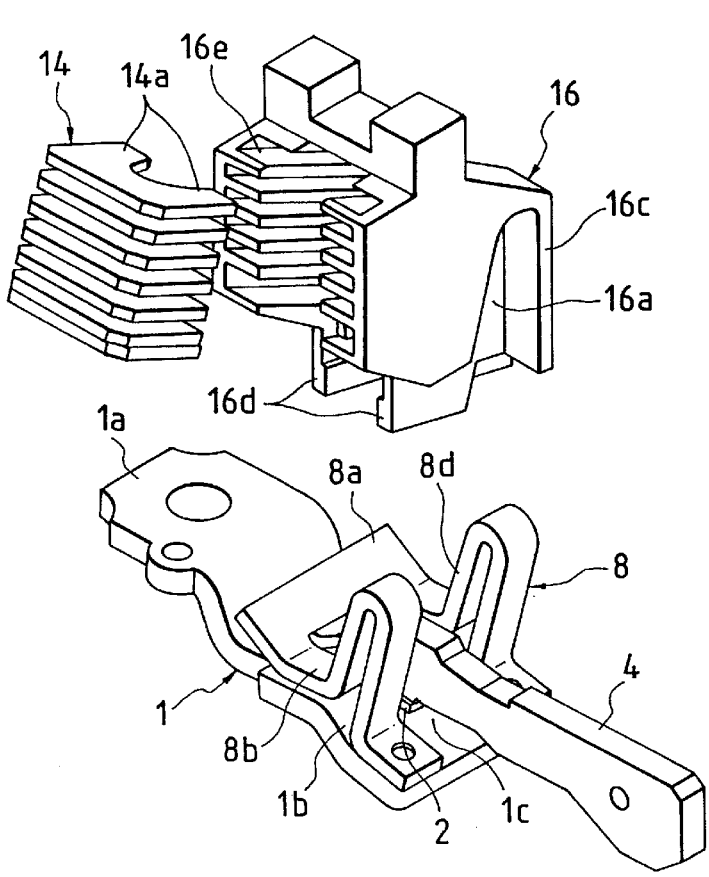
FIG. 16 is an exploded perspective view of the contact portion of FIG. 15.
Figure 17:
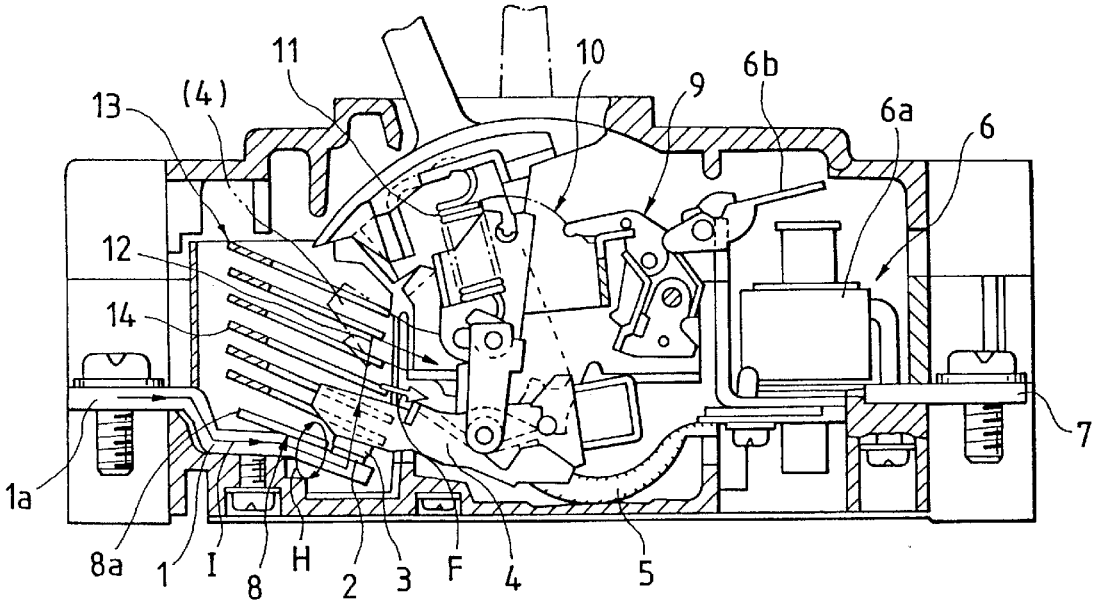
FIG. 17 PRIOR ART
FIG. 17 is a vertical sectional view of a conventional circuit breaker.
Figure 18:
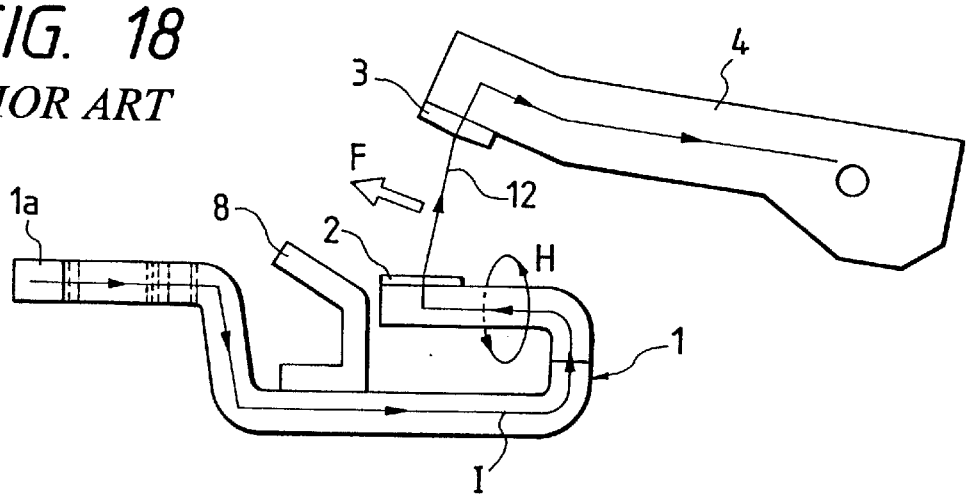
FIG. 18 PRIOR ART
FIG. 18 is a side view of another conventional contact portion.
Figure 19:
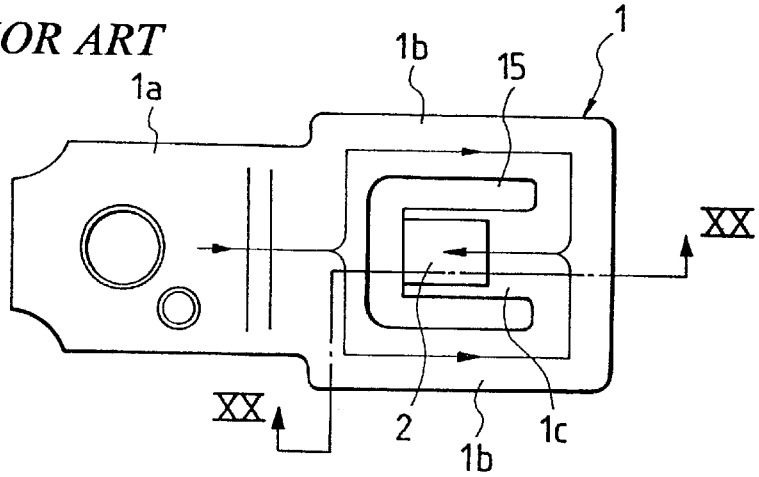
FIG. 19 PRIOR ART
FIG. 19 is a plan view of another conventional fixed contact.
Figure 20:
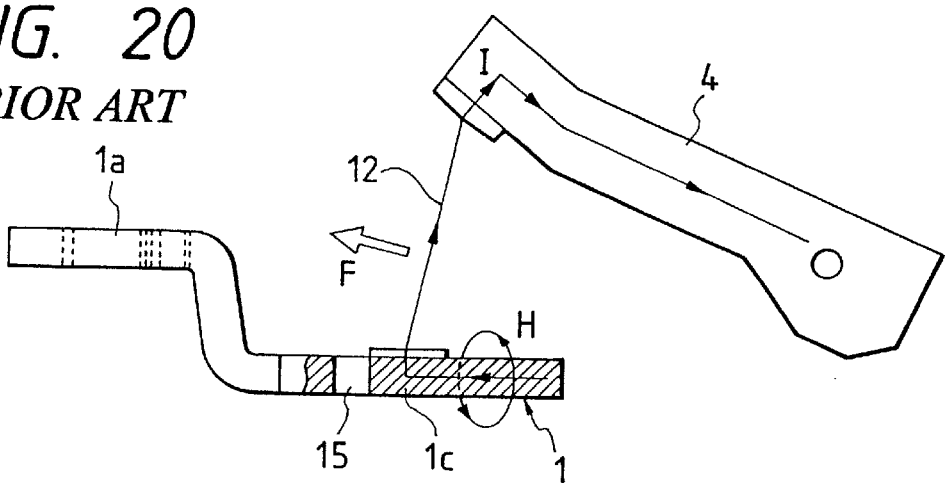
FIG. 20 PRIOR ART
FIG. 20 is a side view of the fixed contact of FIG. 19.
Figure 21:
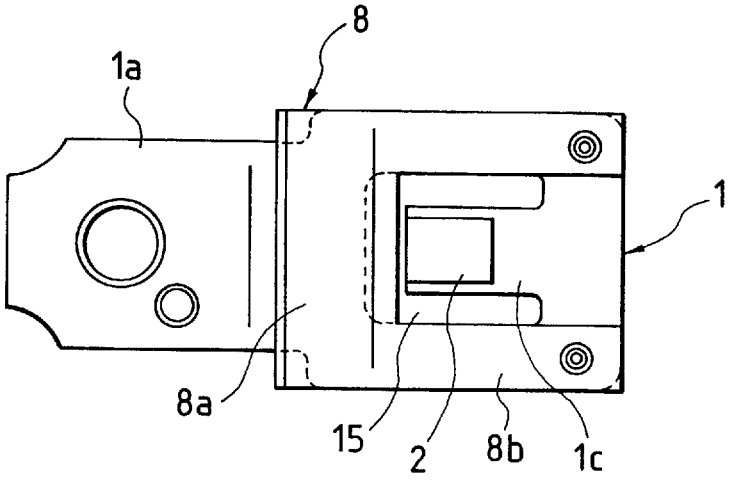
FIG. 21 is a plan view showing a state where an arc horn is provided on the fixed contact shown in FIG. 20.
Figure 22:
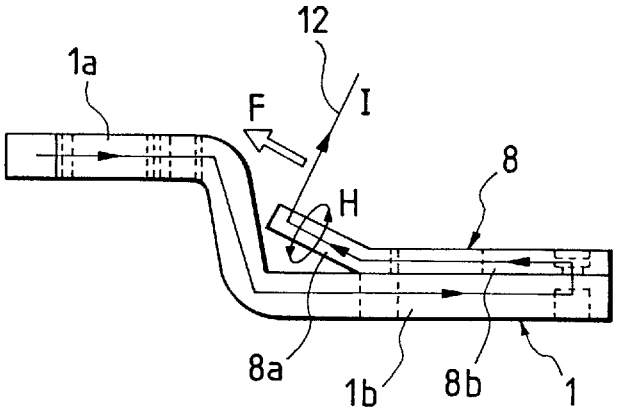
FIG. 22 is a side view of the fixed contact of FIG. 21.

FIGS. 15 and 16 illustrate a still further embodiment of the present invention wherein the grid supporting member is integrally formed with the insulating cover 16 according to Embodiment 6. FIG. 15 is a perspective view of the contact portion; and FIG. 16 an exploded perspective view thereof. As shown in FIG. 16, thick side walls are extended on the front of the insulating cover 16 and the arc-extinguishing grids 14 are pressure-inserted into and held by the respective grooves 16*e* formed in the walls. According to this embodiment of the invention, the construction of the circuit breaker is simplified as the insulating cover 16 is set integral with the arc-extinguishing chamber, and because the left- and right-handed arm portions 14*a* of the arc-extinguishing grids 14 are accommodated in the respective grooves 16*e* and screened from the arc, this section is restrained from being worn off by the arc.

Effect of the Invention

According to the present invention, the movingcontact-side foot of the arc transferred to the arcing horn is maintained in the leading end portion of the moving contact since electromagnetic force acting on the arc is strengthened by the roundabout current path of the arcing horn, so that the wear of the movable contact due to the retention of the arc is reduced.

What is claimed is:

1. A circuit breaker comprising:

a stationary contact piece formed of flat-plate conductor and having a terminal portion formed at one end side and a stationary contact at another end side;

a movable contact piece having a movable contact, said movable contact piece being movable with respect to said stationary contact piece so that said movable contact is removable from said stationary contact along a moving path; and an arcing horn provided on said stationary contact piece, wherein:

said arcing horn has a horn portion extending in a width direction of said stationary contact piece and a pair of arm portions extending from lateral ends of said horn portion to present a U-shape in a plane view, and further has at least one bent roundabout current path formed between said horn portion and each of leading end portions of said arm portions so as to present an inverted-U-shape in a side view; and, said leading end portions of said arm portions are coupled to said stationary contact piece so that said at least one roundabout current path is located opposite to an arc-extinguishing grid with respect to said moving path so that an electromagnetic force caused by current flowing through said roundabout current path pushes an arc toward the arc-extinguishing grid.

2. A circuit breaker as claimed in claim 1, wherein:

said stationary contact piece has a U-shape slit at said another end side to define a pair of outside current paths branching off left and right from said terminal portion and an inside current path turning back toward said terminal portion from a portion where said outside current paths are combined together;

said stationary contact is provided on a distal end of said inside current path; and said arm portions of said arcing horn are respectively coupled to leading ends of said outside current paths.

3. A circuit breaker as claimed in claim 1, wherein two said at least one roundabout current path is provided on each of said arm portions of said arcing horn.

4. A circuit breaker as claimed in claim 1, further comprising:

a resin-molded insulating cover fitted on said at least one roundabout current path.

5. A circuit breaker as claimed in claim 4, wherein said resin-molded insulating cover has an integral arc-extinguishing-grid support portion.

6. A circuit breaker as claimed in claim 1, wherein said stationary contact is located between said terminal portion and said leading end portions of said arm portions in said side and plane views.

7. A circuit breaker as claimed in claim 1, wherein said leading end portions of said arm portions are located between said terminal portion and said stationary contact in said side and plane views.

8. A circuit breaker as claimed in claim 1, wherein a portion of said roundabout conductor path facing the arc extends substantially adjacent and parallel to the arc.

9. A circuit breaker as claimed in claim 1, wherein a portion of said roundabout conductor path facing the arc has current flowing in a direction opposite current flowing in the arc.

10. A circuit breaker a stationary contact piece formed of a flat-plate conductor and having a terminal portion formed at one end side and a stationary contact at another end side;

a movable contact piece having a movable contact, said movable contact piece being movable with respect to said stationary contact piece so that said movable contact is removable from said stationary contact along a moving path; and an arcing horn provided on said stationary contact piece, wherein:

said arcing horn has a horn portion extending in a width direction of said stationary contact piece and a pair of arm portions extending from lateral ends of said horn portion to present a U-shape in a plane view, and further has at least one bent roundabout current path formed between said horn portion and each of leading end portions of said arm portions so as to present an inverted-U-shape in a side view; and, said leading end portions of said arm portions are coupled to said stationary contact piece so that said at least one roundabout current path is located opposite to said terminal portion of said stationary contact piece with respect to said moving path, wherein said at least one roundabout current path has a linear portion at an upper-end bent portion, and said linear portion is located lower than and extends substantially parallel to a conductor portion of said movable contact piece which has been removed completely from said stationary contact piece.

11. A circuit breaker comprising:

a stationary contact piece formed of flat-plate conductor and having a terminal portion formed at one end side and a stationary contact at another end side;

a movable contact piece having a movable contact, said movable contact piece being movable with respect to said stationary contact piece so that said movable contact is removable from said stationary contact along a moving path; and an arcing horn provided on said stationary contact piece, wherein:

said arcing horn has a horn portion extending in a width direction of said stationary contact piece and a pair of arm portions extending from lateral ends of said horn portion to present a U-shape in a plane view, and further has at least one bent roundabout current path formed between said horn portion and each of leading end portions of said arm portions so as to present an inverted-U-shape in a side view; and, said leading end portions of said arm portions are coupled to said stationary contact piece so that said at least one roundabout current path is located opposite to an arc-extinguishing grid with respect to said moving path so that an electromagnetic force caused by current flowing through said roundabout current path pushes an arc toward the arc-extinguishing grid, wherein an upper end bent portion of said at least one roundabout current path is located adjacent said movable contact piece when said movable contact piece has been removed completely from said stationary contact piece.

12. A circuit breaker as claimed in claim 11, wherein:

said stationary contact piece has a U-shape slit at said another end side to define a pair of outside current paths branching off left and right from said terminal portion and an inside current path turning back toward said terminal portion from a portion where said outside current paths are combined together;

said stationary contact is provided on a distal end of said inside current path; and said arm portions of said arcing horn are respectively coupled to leading ends of said outside current paths.

13. A circuit breaker as claimed in claim 11, wherein two said at least one roundabout current path is provided on each of said arm portions of said arcing horn.

14. A circuit breaker as claimed in claim 11, further comprising:

a resin-molded insulating cover fitted on said at least one roundabout current path.

15. A circuit breaker as claimed in claim 14, wherein said resin-molded insulating cover has an integral arc-extinguishing-grid support portion.

16. A circuit breaker as claimed in claim 11, wherein said stationary contact is located between said terminal portion and said leading end portions of said arm portions in said side and plane views.

17. A circuit breaker as claimed in claim 11, wherein said leading end portions of said arm portions are located between said terminal portion and said stationary contact in said side and plane views.

18. A circuit breaker as claimed in claim 11, wherein a portion of said roundabout conductor path facing the arc extends substantially adjacent and parallel to the arc.

19. A circuit breaker as claimed in claim 11, wherein a portion of said roundabout conductor path facing the arc has current flowing in a direction opposite current flowing in the arc.

20. A circuit breaker comprising:

a stationary contact piece formed of flat-plate conductor and having a terminal portion formed at one end side and a stationary contact at another end side;

a movable contact piece having a movable contact, said movable contact piece being movable with respect to said stationary contact piece so that said movable contact is removable from said stationary contact along a moving path; and an arcing horn provided on said stationary contact piece, wherein:

said arcing horn has a horn portion extending in a width direction of said stationary contact piece and a pair of arm portions extending from lateral ends of said horn portion to present a U-shape in a plane view, and further has at least one bent roundabout current path formed between said horn portion and each of leading end portions of said arm portions so as to present an inverted-U-shape in a side view; and, said leading end portions of said arm portions are coupled to said stationary contact piece so that said at least one roundabout current path is located opposite to said terminal portion of said stationary contact piece with respect to said moving path, wherein an upper end bent portion of said at least one roundabout current path is located adjacent said movable contact piece when said movable contact piece has been removed completely from said stationary contact piece, wherein said at least one roundabout current path has a linear portion at said upper-end bent portion, and said linear portion is located lower than and extends substantially parallel to a conductor portion of said movable contact piece which has been removed completely from said stationary contact piece.

* * * * *